United States Patent [19]

Delphia

[11] Patent Number: 4,610,246

[45] Date of Patent: Sep. 9, 1986

[54] SNORKEL VALVE ASSEMBLY

[76] Inventor: John B. Delphia, 1021 Schuyler Dr., Milford, Mich. 48042

[21] Appl. No.: 712,636

[22] Filed: Mar. 18, 1985

[51] Int. Cl.[4] ..... B63C 11/16

[52] U.S. Cl. ..... 128/201.11; 128/205.24

[58] Field of Search ..... 128/201.11, 207.16, 128/207.12, 201.27

[56] References Cited

U.S. PATENT DOCUMENTS

| | | | |
|---|---|---|---|
| 1,867,478 | 7/1932 | Stelzner | 128/207.12 |
| 3,990,439 | 11/1976 | Klinger | 128/207.12 |
| 4,040,428 | 8/1977 | Clifford | 128/207.16 |
| 4,325,366 | 4/1982 | Tabor | 128/207.16 |

*Primary Examiner*—Henry J. Recla

*Attorney, Agent, or Firm*—Harold W. Milton, Jr.

[57] ABSTRACT

A snorkel valve assembly (34) including a sleeve (28) having a rim (30) and defining an opening (32). The assembly (34) includes a diaphragm member (36) having a peripheral sealing surface (38) for selectively sealing off the opening (32) by sealing engagement of the sealing surface (38) with the rim (30). The diaphragm member (36) has a pushed closed position wherein fluid flow within the sleeve (28) draws the sealing surface (38) of the diaphragm member (36) into sealing engagement with the rim (30) and a neutral position when there is no fluid flow within the sleeve (28) space wherein at least a portion of the sealing surface (38) is spaced from the seating rim (30).

14 Claims, 5 Drawing Figures

SNORKEL VALVE ASSEMBLY

TECHNICAL FIELD

The instant invention relates to a fresh air diving snorkel of the type used in the sport of skin diving. More specifically, the instant invention relates to a valve assembly for a snorkel.

BACKGROUND ART

Diving snorkel assemblies are used by divers for breathing air above the water without having to bring one's head out of the water. Most state of the art snorkel assemblies include a valve mechanism for allowing the influx of air during inhaling by the diver while preventing the inlet of water. For example, the U.S. Pat. No. 3,860,042 to Green issued Jan. 14, 1975, discloses a snorkel assembly including an inlet member having a flexible valve member supported therein by a support member. The valve member includes a stem portion and nipple which is inserted through the opening in a support member whereby the peripheral edge of the valve member seals against the rim of the inlet member. When there is no inhaling or exhaling involved, the peripheral surface of the valve member is seated against the rim of the inlet member. The snorkel disclosed in the Green patent is an example of an assembly including an air inlet to be disposed above the water to allow the inlet of air during inhaling by the diver and an air exhaust disposed of below the water for allowing the exhaust of air through a separate outlet. The inlet and outlet each have a valve mechanism. The copending U.S. patent application Ser. No. 553,506 to applicant, filed Nov. 21, 1983, discloses an improved fresh air snorkel including an inlet and a separate outlet. The inlet and outlet each include one way valve mechanisms.

In conventional snorkels, when the surfaces of the inlet member and valve member are wet, a seal is formed between the valve member and inlet member by the moisture. The amount of effort to effect inhalation is increased as the fluid seal must be broken. The U.S. Pat. No. 3,990,439 to Klinger issued Nov. 9, 1976, discloses a check valve for a respirator or a gas mask including a valve support and a nipple or aligning pin which engages a valve disc. The peripheral sealing surface of the valve disc is seated on the support. The U.S. Pat. No. 3,519,012 to Van Patten, issued July 7, 1970, discloses a similar valve mechanism including a valve disc seated in its neutral position against a valve seat.

In each of the aforementioned valve devices, the surfaces of the inlet member and valve member when wet are sealed together by the moisture. The inhalation effort is increased as the fluid seal must be broken. The increased inhalation effort required to utilize the apparatus have made the apparatus difficult to use and commercially ineffective. The instant invention provides improves improved fluid flow through valve mechanism by alleviating the problem of the moisture seal.

STATEMENT OF THE INVENTION

According to the present invention, there is provided a snorkel valve assembly including a sleeve having a rim defining an opening. The assembly also includes diaphragm means having a peripheral sealing surface for selectively sealing off the opening by sealing engagement of the sealing surface with the rim. The assembly is characterized by the diaphragm means having a pushed closed position wherein fluid flow within the sleeve draws the sealing surface of the diaphragm means into sealing engagement with the rim and a neutral position when there is no fluid flow within the sleeve wherein at least a portion of the sealing surface is spaced from the rim.

As air pressure from exhaling during submersion will always push the inhalation valve closed, it is possible to improve the inhalation effort by the subject invention which provides a valve which is slightly open rather than sitting on the rim of the sleeve when in its neutral position.

FIGURES IN THE DRAWINGS

Other advantages of the present invention will be readily appreciated as the same becomes better understood by reference to the following detailed description when considered in connection with the accompanying drawings wherein.

DETAILED DESCRIPTION OF THE DRAWINGS

Referring to the Figures, a diving snorkel assembly constructed in accordance invention is generally shown at 10.

Figure 1:
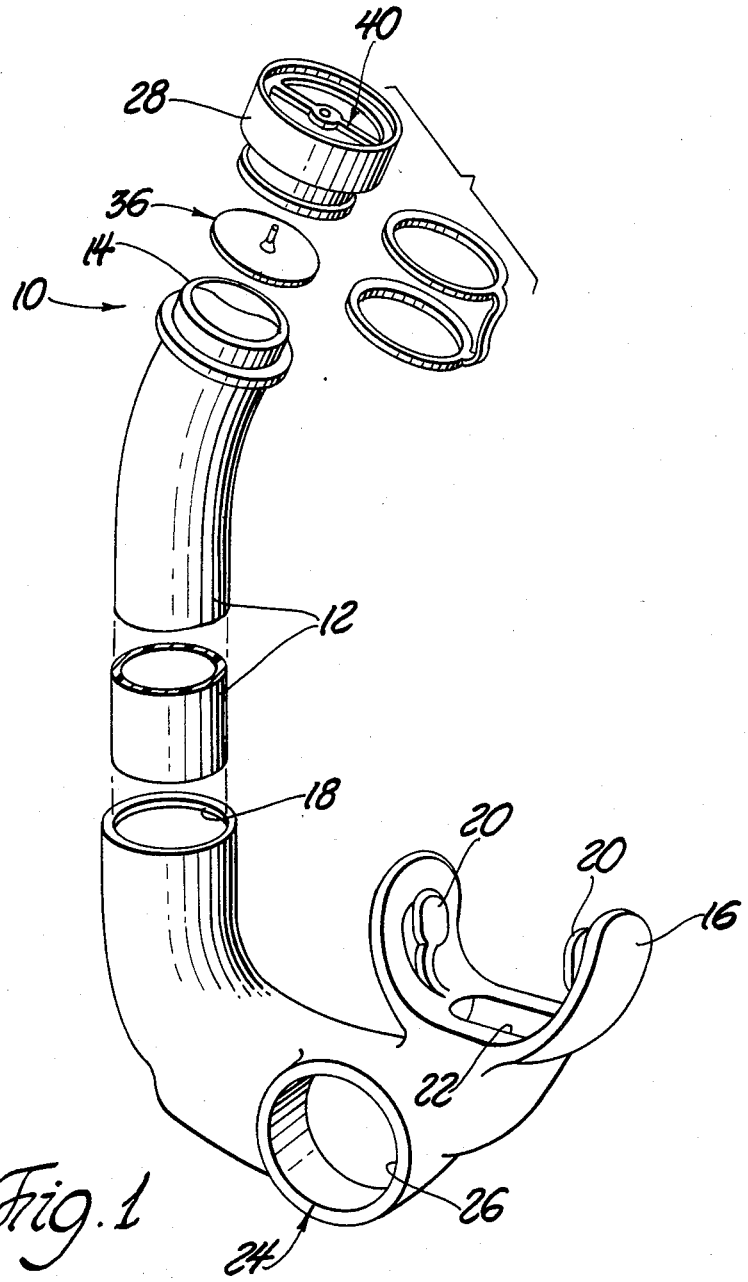
FIG. 1 is a prospective exploded view of the subject invention.
Figure 2:
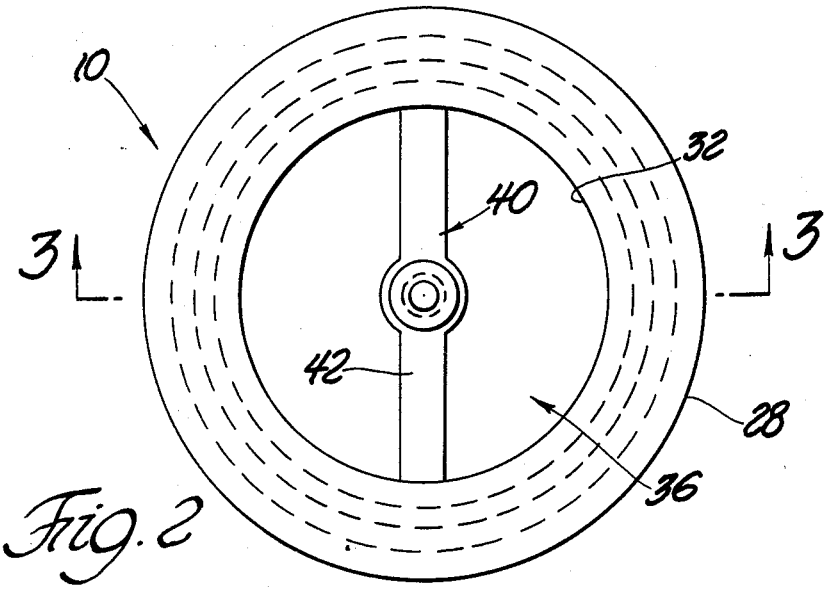
FIG. 2 is a plan view of the subject invention.

Referring specifically to FIG. 1, the assembly 10 includes a snorkel tube 12 having an inlet end 14 at one end. A mouth piece 16 extends integrally from the snorkel tube 12 at the opposite end thereof. Alternately, the mouth piece 16 may be formed as a separate part and attached to the snorkel tube assembly 10 by means well known in the art. The snorkel tube 12 defines a fluid passageway 18 extending between the inlet end 14 of the tube 12 and the mouth piece 16. In normal use, air is drawn in through the inlet end 14 of the snorkel tube 12 by suction on the mouthpiece 16. The mouthpiece 16 may include projecting knobs 20 which are retained by the teeth of the diver. The projection knobs 20 are disposed about an opening 22 of the fluid passageway 18 and extend into the mouthpiece 16.

Exhaust means generally indicated at 24 is disposed between the mouthpiece 16 and the inlet end 14 of the snorkel tube 12 for allowing one way exhaust of fluid from the fluid passageway 18. As shown in FIG. 1, the exhaust means 24 comprises a fluid opening 26. An exhaust valve, such as the exhaust valve disclosed in the U.S. patent application Ser. No. 553,506, to applicant, may be disposed thereover. Alternately, a valve mechanism constructed in accordance with the instant invention may be provided for one way exhaust of fluid from the fluid passageway 18. In normal use, exhaust air from the diver is forced through the opening 22 in the mouthpiece 16 and out through the exhaust means 24. The exhaust means 24 will provide a one way valve which does not allow the inlet of air therethrough in response to the intake of air by the diver through the inlet end 14 of the tube 12 and the mouthpiece 16.

Figure 3:
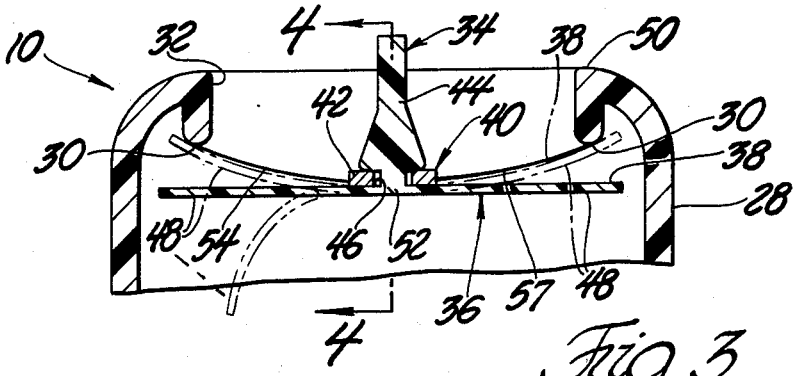
FIG. 3 is a cross sectional view taken along lines 3—3 of FIG. 2.
Figure 4:
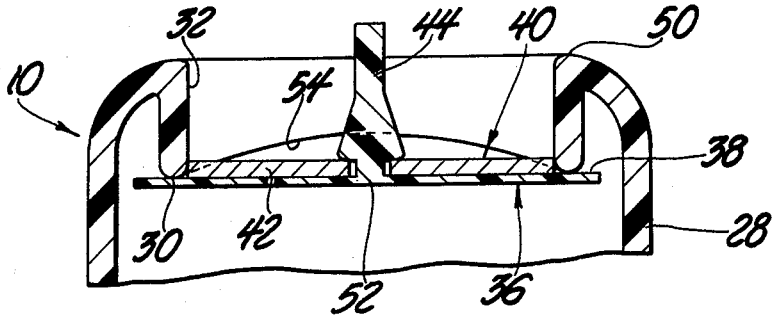
FIG. 4 is a cross section view taken substantially along lines 4—4 of FIG. 3.
Figure 5:
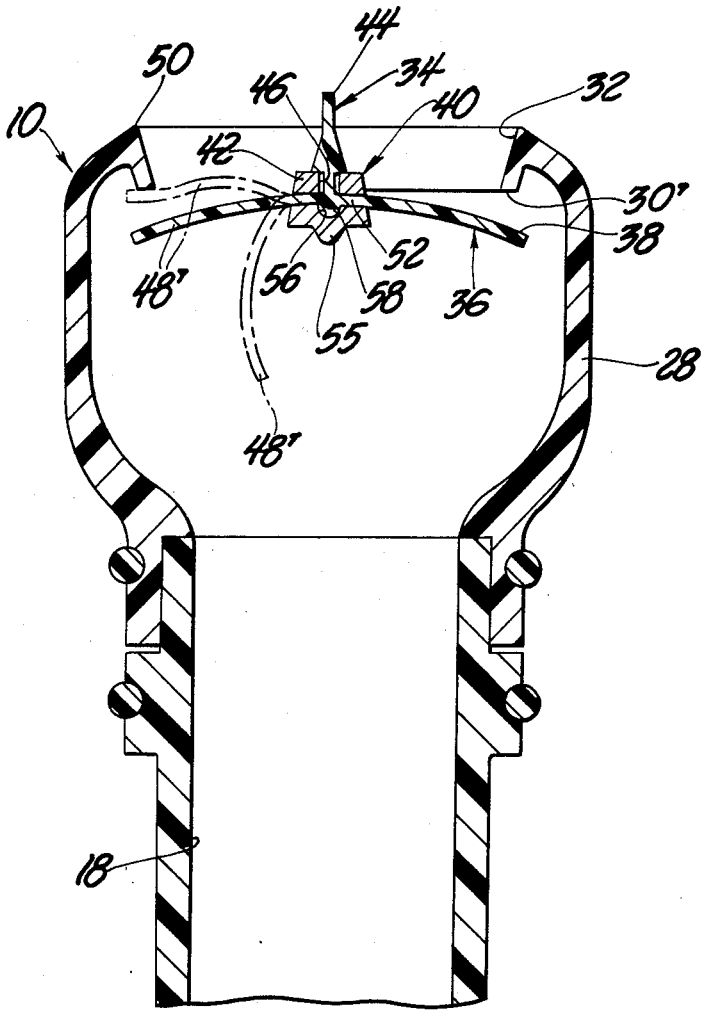
FIG. 5 is a cross sectional view of a second embodiment of the subject invention.

The inlet end 14 includes a sleeve 28 having a seating rim 30, as shown in FIGS. 3, 4 and 5, the seating rim defining an opening 32. The sleeve 28 retains therein the snorkel valve assembly generally indicated at 34. The snorkel valve assembly 34 includes the sleeve 28 and diaphragm means for selectively sealing off the opening 32 by sealing engagement with the seating rim 30. More particularly, the diaphragm means includes a diaphragm member generally indicated at 36 having a peripheral sealing surface 38 for selectively sealing off the opening 32 by sealing engagement of the sealing surface 38 with the seating rim 30. The snorkel valve assembly 34 is characterized by the diaphragm member 36 having a pushed closed position as shown in phantom in FIGS. 3 and 5 wherein fluid flow within the sleeve 28 draws the sealing surface 38 of the diaphragm member 36 into sealing engagement with the seating rim 30, and a neutral position shown in solid lines in FIGS. 3 and 5 when there is no fluid flow within the sleeve 28 wherein at least a portion of the sealing surface 38 is spaced from the seating rim 30. In other words, the snorkel valve mechanism 34 includes the sleeve 28 having the seating rim 30 and the valve mechanism 34 which forms a seal upon pressure from exhalation wherein at rest the sealing surface of the valve mechanism 34 is spaced from the seating rim 30. In the neutral position, as the valve mechanism 34 is spaced from the seating rim 30, there is no fluid seal therebetween. Accordingly, there is an increased fluid flow efficiency as inhalation is easier to initiate. Inhalation is easier to begin because there is no fluid seal which must be broken upon initiating inhalation.

To increase fluid flow efficiency, the diaphragm member 36 includes biasing means for biasing the portion of the sealing surface 38 away from the seating rim 30 to the neutral position when there is no fluid flow through the sleeve. The valve mechanism tends to flex away from the seating rim 30 upon release of the exhaust thereby increasing fluid flow efficiency and making it easier to begin inhaling.

More specifically, the assembly includes support means generally indicated at 40 for supporting the diaphragm 36 within the opening 32 of the sleeve 28. The support means 40 includes a first arm 42 extending across the opening 32 and adjacent to a portion of the seating rim 30 as shown in cross section in FIG. 3. The diaphragm member 36 is operatively connected to the arm 40 by a nipple portion 44 extending through an opening 46 in the arm 42. Other means well known in the art may be used to connect the flexible diaphragm member 36 to the arm 42.

The biasing means includes a pair of flexible wings 48 of the diaphragm member 36 extending away from the arm 40. Each of the wings 48 includes a portion of the sealing surface 38. The sealing surface 38 of the flexible wings 48 is spaced from the seating rim 30 when the diaphragm member 36 is in the neutral position as shown in solid lines in FIGS. 3 and 5 and flexes in response to fluid flow to seat the sealing surfaces 38 against the seating rim 30 in the pushed closed position.

As shown in phantom in FIGS. 3 and 5, the diaphragm member 36 includes a pushed open position wherein fluid flow flexes the flexible wings 48 away from the seating rim 30. The flexible wings 48 in the pushed open position further opens the opening 32 to fluid flow into the fluid passageway 18.

The sleeve 28 has an end portion 50 projecting into the opening 32 and having a peripheral edge defining the seating rim 30. As shown in FIGS. 3 through 5, this particular structure may take the form of a rolled in end portion of the sleeve 28.

The diaphragm 36 includes a flat middle portion 52 defining a plane, the middle portion 52 including the nipple portion 44 extending therefrom which is connected to the arm 42. The flexible wings 48 extend away from the middle portion 52.

As shown in FIGS. 3 and 4, the flexible wings 48 extend from the middle portion 52 of the diaphragm member 36 along a plane thereby defining a substantially flat diaphragm member 36. The seating rim 30 is substantially circular about the opening 32 and includes two substantially semicircular portions 54 and 57 interconnected by an intermediate portion disposed substantially on the plane. Each of the semicircular portions 54,56 angle relative to the plane defined by the middle portion 52 of the diaphragm member 36 and away from the sealing surfaces 38 of the flexible wings 48. As shown in solid lines in FIG. 3, the wings 48 are spaced from the curved rim 30 when the diaphragm member 36 is in the neutral position. The diaphragm member 36 may take various shapes in order to provide a sufficiently large surface whereby the sealing surfaces 38 contact the seating rim 30 upon flexure of the flexible wings 48.

A second embodiment of the instant invention is shown in FIG. 5. Like numerals are used to indicate like structure among the several embodiments. The flexible wings 48' are angled relative to the plane defined by the middle portion 52 of the diaphragm member 36 and away from the seating rim 30'. The seating rim 30' is flat and disposed adjacent to the plane defined by the middle portion 52 of the diaphragm member 36.

The assembly includes anti-rotation means for preventing rotation of the diaphragm member 36 relative to the seating rim 30. As the opening 32 may take the form of an oblong circle to provide and increased inlet opening area and thereby provide greater fluid flow efficiency, it may be necessary to prevent rotation of the diaphragm member 36 and align the flexible wings 48'. The anti-rotation means include a second support member 55 having a groove 56 therein. The middle portion 52 of the diaphragm member 36 includes a rib 58 projecting therefrom and seated in the groove 56. Alternatively, the middle portion 52 may include the groove and the support member 55 may include a rib seated in the groove. As shown in FIG. 5, the middle portion 52 of the diaphragm member 36 is clamped between the support arms 42 and 55.

In use, the valve member 36 has the two flexible wings 48' folded slightly downwardly so that in its neutral position the valve mechanism 34 is slightly open. As shown in phantom, the valve mechanism 34 is in the pushed closed position, actuated by exhalation pressure. The sealing surface 38 is seated against the seating rim 30. The downwardly extending wings 48' facilitate continued downward flexure in the pushed open position thereby increasing efficiency of fluid flow and making it easier to begin the inhaling.

The invention has been described in an illustrative manner, and it is to be understood that the terminology which has been used is intended to be in the nature of words of description rather than of limitation.

Obviously, many modifications and variations of the present invention are possible in light of the above teachings. It is, therefore, to be understood that within the scope of the appended claims wherein reference numerals are merely for convenience and are not to be in any way limiting, the invention may be practiced otherwise than as specifically described.

What is claimed is:

1. A diving snorkel assembly (10) comprising: a snorkel tube (12) having an air inlet at one end (14) and a mouth piece (16) at the opposite end, said tube (12) defining a fluid passageway (18) extending between said inlet end (14) of said tube (12) and said mouth piece (16), said one end (14) including a sleeve mounted thereon and (28) having a seating rim (30,30') defining said air inlet (32); exhaust means (24) spaced from said mouthpiece (16) and said inlet end (14) of said tube (12) for allowing one way exhaust of fluid from said fluid passageway (18); and a diaphragm member having a sealing surface (38) mounted in said sleeve transverses to such rim and spaced therefrom such that said diaphragm member has a pushed closed position wherein fluid flow within said sleeve (28) draws said sealing surface (38) of said diaphragm member (36) into sealing engagement with said seating rim (30,30') and a neutral position when there is no fluid flow within said sleeve (28) wherein at least a portion of said sealing surface (38) is spaced from said seating rim (30).

2. An assembly as set forth in claim 1 further characterized by diaphragm member (36) including biasing means for biasing said portion of said sealing surface (38) away from said seating rim (30,30') to said neutral position when there is no fluid flow through said sleeve (28).

3. An assembly as set forth in claim 2 further characterized by including support means (40) for supporting said diaphragm member (36) within said opening (32) of said sleeve (28), said support means (40) including at least one arm (42) extending across said opening (32) and adjacent to at least a portion of said seating rim (30,30') and said diaphragm member (36) being operatively connected to said arm (40).

4. An assembly as set forth in claim 3 further characterized by said biasing means including a pair of flexible wings (48,48') of said diaphragm member (36) extending away from said arm (40) and each of said wings (48,48') including a portion of said sealing surface (38), said sealing surface (38) of said flexible wings (48,48') being spaced from said seating rim (30,30') when said diaphragm member (36) is in the neutral position and flexing in response to fluid flow to seat said sealing surfaces (38) against said seating rim (30,30') in said pushed closed position.

5. An assembly as set forth in claim 4 further characterized by said diaphragm member (36) including a pushed open position wherein fluid flow flexes said wings (48,48') away from said seating rim (30,30').

6. An assembly as set forth in claim 5 further characterized by said sleeve (28) having an end portion (50) projecting into said opening (32) and having a peripheral edge defining said seating rim (30,30').

7. An assembly as set forth in claim 6 further characterized by said diaphragm member (36) including a flat middle portion (52) defining a plane and operatively connected to said arm (42), said flexible wings (48,48') extending away from said middle portion (52).

8. An assembly as set forth in claim 7 further characterized by said flexible wings (48') being angled relative to said plane and away from said seating rim (30').

9. An assembly as set forth in claim 8 further characterized by said seating rim (30') being flat and disposed adjacent to said plane.

10. An assembly as set forth in claim 7 including anti-rotation means for preventing rotation of said diaphragm member (36) relative to said seating rim (30').

11. An assembly as set forth in claim 10 further characterized by said anti-rotation means including a support member (55) having a groove (56), said middle portion (52) of said diaphragm member (36) having a rib (58) seated in said groove (56).

12. An assembly as set forth in claim 11 further characterized by said mounting means including a pair of arms (42,55), one of said arms (55) including said groove (56), said middle portion (52) of said diaphragm member (36) being clamped between said arms (42,55), said middle portion (52) including said rib (58) projecting therefrom and seated within said groove (56).

13. An assembly as set forth in claim 7 further characterized by said flexible wings (48) extending from said middle portion (52) of said diaphragm member (36) along said plane defining a substantially flat diaphragm member (36).

14. An assembly as set forth in claim 13 further characterized by said seating rim (30) being substantially circular about said opening (32) and including two substantially semicircular portion (54,56) interconnected by an intermediate portion disposed substantially on said plane, each of said semicircular sections (54,56) angling relative to said plane and away from said sealing surfaces (38) of said flexible wings (48).

* * * * *